United States Patent [19]

Okuno et al.

[11] Patent Number: 4,595,129

[45] Date of Patent: Jun. 17, 1986

[54] MOISTUREPROOF SEALING OF A CONTAINER

[75] Inventors: Eiichi Okuno, Tochigi; Naomi Okamura; Keiji Ozawa, both of Sohwa; Takashi Saitoh, Tokyo, all of Japan

[73] Assignee: Cemedine Co., Ltd., Tokyo, Japan

[21] Appl. No.: 566,429

[22] Filed: Dec. 28, 1983

[51] Int. Cl.[4] ..... B65D 81/26; B65D 8/04

[52] U.S. Cl. ..... 222/327; 222/386; 528/44; 528/48; 528/55; 106/33; 252/186.25

[58] Field of Search ..... 222/327

[56] References Cited

U.S. PATENT DOCUMENTS

| | | | |
|---|---|---|---|
| 3,527,389 | 9/1970 | Farmer | 222/327 |
| 4,027,810 | 6/1977 | van Manen | 222/327 |
| 4,036,360 | 7/1977 | Deffeyes | 524/871 |
| 4,189,418 | 2/1980 | Ueno et al. | 524/447 |
| 4,201,308 | 5/1980 | Neumann | 524/444 |
| 4,217,995 | 8/1980 | Robillard | 222/327 |
| 4,323,177 | 4/1982 | Nielsen | 222/386 |

FOREIGN PATENT DOCUMENTS

| | | |
|---|---|---|
| 81145 | 6/1983 | European Pat. Off. . |
| 55-31809 | 3/1980 | Japan . |
| 59-01376 | 1/1984 | Japan . |

*Primary Examiner*—A. Lionel Clingman

*Attorney, Agent, or Firm*—Oblon, Fisher, Spivak, McClelland & Maier

[57] ABSTRACT

A container for storing a moisture-sensitive material which comprises a fillable space behind the moisture-sensitive material, which has contained therein a water-reactive, highly volatile silane, alkyl titanate or isocyanate which, upon reaction with water, produces a low-viscosity material which is water repellant. The water-reactive compound prevents contact of moisture with the moisture-sensitive material while it is in the container.

13 Claims, 5 Drawing Figures

MOISTUREPROOF SEALING OF A CONTAINER

BACKGROUND OF THE INVENTION

1. Field of the Invention

The present invention relates to moistureproof sealing of a container. More particularly, it relates to shielding from moisture a moisture absorptive or moisture curable composition stored in a container having a lid caulked along its periphery to the mouth of the container.

2. Description of the Prior Art

A container such as, a drum, or a cartridge, has a lid caulked along its periphery to the mouth of the container. By such a caulked structure, the container is sealed more or less and, as such, is used for storing a moisture absorptive material or a moisture curable composition. However, such sealing is not complete in a strict sense, and it frequently occurs that the stored material or composition undergoes a property change upon absorption of moisture coming in through the sealing portion or solidifies to close the mouth portion of the container.

In order to prevent such a problem, it has been common to employ a physical method for the prevention of the moisture, e.g. such that an inert gas such as nitrogen or carbon dioxide gas is filled in the container, or a solid moisture absorber such as quick lime, silica gel or zeolite is used. However, such a physical method has not yet adequately solved the problem. Namely, in the case where an inert gas is filled in the container, the air in the container is simply replaced by the inert gas, and the effect thereby obtainable is the prevention of oxidation rather than the prevention of moisture. Such a method is intended primarily to prevent the oxidation of the stored material and thereby to prevent the polymerization or solidification of the material at room temperature. In the case of the solid moisture absorber, the moisture absorbing effect is obtainable only when the air containing moisture contacts the absorber which is usually contained in an inner receptacle placed in the container, and thus, the absorber does not provide any positive effect to prevent the inflow of the moisture through the sealing portion along the mouth of the container. Further, the moisture absorber loses its moisture absorbing property upon absorption of moisture. Therefore, once the absorber has absorbed moisture to saturation, it no longer serves as a moisture absorber. Thus, its effective life is limited. For these reasons, no adequate moistureproofing effect has been attained by such conventional physical methods.

SUMMARY OF THE INVENTION

It has now been found possible to effectively and positively prevent the inflow of the moisture by using a chemical reagent as a moistureproof agent, which is highly volatile and capable of reacting with the incoming moisture to form a low viscosity substance which seals the sealing portion at the mouth of the container.

Thus, the present invention provides for the moistureproof sealing of a container for a moisture absorptive or moisture curable composition having a lid caulked along its periphery to the mouth of the container, wherein an inner receptacle containing a moistureproof agent is slidably fitted in the container and normally positioned close to the mouth of the container, wherein the moistureproof agent is a chemical reagent consisting essentially of at least one member selected from the group consisting of an isocyanate, a silane, an alkyl titanate and mixtures thereof.

Now, the present invention will be described in detail with reference to the preferred embodiments.

BRIEF DESCRIPTION OF THE DRAWINGS

FIG. 2(*b*) is a plan view of the lid of the cartridge of FIG. 2(*a*).

DETAILED DESCRIPTION OF THE PREFERRED EMBODIMENTS

The chemical reagent used in the present invention is an isocyanate, a silane or an alkyl titanate, which preferably has a low molecular weight within a range of from 100 to 1000.

The isocyanate is a compound having a terminal —NCO group and being capable of reacting with water to produce $CO_2$ and to form a di-substituted urea derivative having a group represented by the formula —NH-CONH—.

The silane is an organic silicon compound which is capable of reacting with water to liberate an alcohol, an oxime, acetic acid, a ketone and the like. More specifically, the silane is a compound having a hydrolyzable group represented by the formula:

$$X_{4-a}-\overset{\overset{R_a^1}{|}}{Si}-$$

where $R^1$ is a monovalent hydrocarbon group having from 1 to 12 carbon atoms selected from an alkyl group and an aryl group, or an alkylsilyloxy group, X is an alkoxy group, an amido group, an acid amido group, an aminooxy group, an amino group, a mercapto group or a silyloxy group having a hydrolyzable functional group, and a is an integer of 0, 1 or 2.

The alkyl titanate is a reactive compound represented by the formula:

$$Ti(OR^2)_4$$

where $R^2$ is a monovalent hydrocarbon group having from 1 to 6 carbon atoms, which is capable of reacting with moisture to form a colorless transparent film having water repellency.

These chemical reagents are highly volatile or have the ability to flow, and thus they are capable of reacting with the moisture coming in through the sealing portion of the mouth of the container, to form a film of a low viscosity which serves as a moisture barrier to prevent the influx of moisture, whereby the solidification of the stored material or the formation of a viscous substance due to the reaction of the stored material with water can be prevented.

The container to which the present invention is applicable, includes a storage can drum, and cartridge which is designed to be mounted on a dispensing gun and which is provided with a discharge nozzle through which the stored material is discharged.

Figure 1:
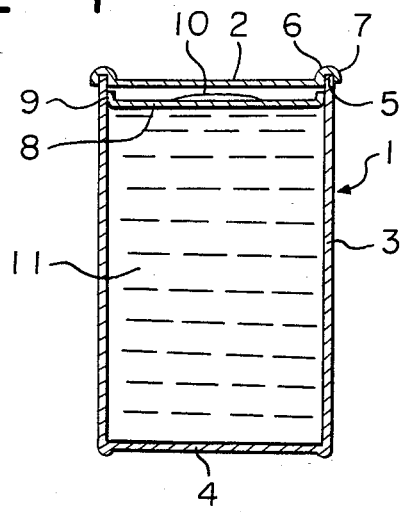
FIG. 1 is a cross sectional view of a drum as an embodiment of the present invention.

FIG. 1 shows a cross section of a drum as an embodiment of the present invention. In this Figure, the reference numeral 1 designates a drum, numeral 2 designates a lid thereof, numeral 3 designates the body thereof, numeral 4 designates the bottom thereof, numeral 5 designates the mouth thereof, numeral 6 designates the joint portion between the lid and the can body, numeral 7 indicates the caulked portion of the lid, numeral 8 designates a shallow inner receptacle, numeral 9 indicates the sliding contact portion between the inner receptacle and the mouth of the can body, numeral 10 designates a chemical reagent placed in the inner receptacle, and numeral 11 designates a moisture absorptive material or a moisture curable composition stored in the can.

Figure 2A:
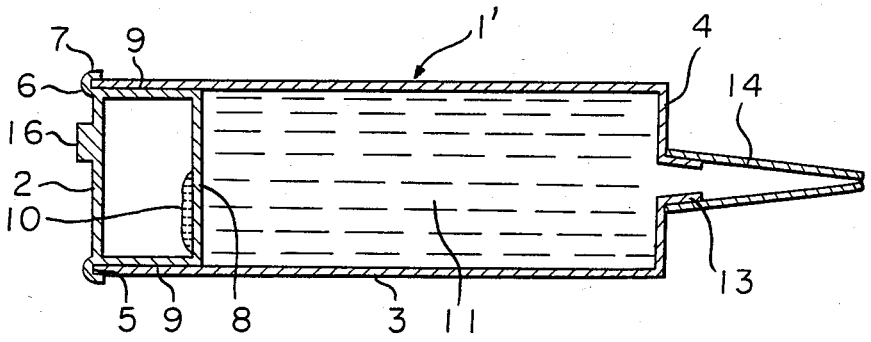
FIG. 2(*a*) is a cross sectional view of a cartridge as another embodiment of the present invention.
Figure 2B:
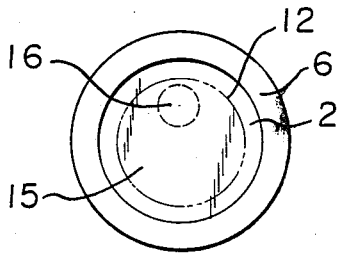

FIG. 2(*a*) shows a cross section of a cartridge, and FIG. 2(*b*) shows a plan view of the lid of the cartridge. In these Figures, reference numerals 1' generally designates the cartridge, and reference numerals 2 to 11 designate the parts or materials corresponding to those of FIG. 1. In contrast to the drum of FIG. 1, the cartridge of FIG. 2(*a*) is provided with a discharge nozzle 14 attached to a protruded outlet 13 at the end opposite to the mouth of the cartridge. Further, as shown in FIG. 2(*b*), the lid 2 has a punchable portion defined by a punching line 12, which is preferably engraved to a depth corresponding to about a half of the wall thickness of the lid 2. The punchable portion 15 will be punched out along the punching line 12 by a plunger of a dispenser gun (not shown), and as the plunger of the gun further advances, it pushes the inner receptable 8, which will then serve as a means to push the stored material 11, whereby the stored material will be discharged under pressure through the discharge nozzle 14. The punchable portion 15 has a projection 16 adjacent to the punching line 12, so that when the punchable portion is pushed by a plunder of a gun, the tearing stress is concentrated on the projection 16, whereby the tear or rupture will start from the position adjacent to the projection along the punching line 12.

Figure 3:
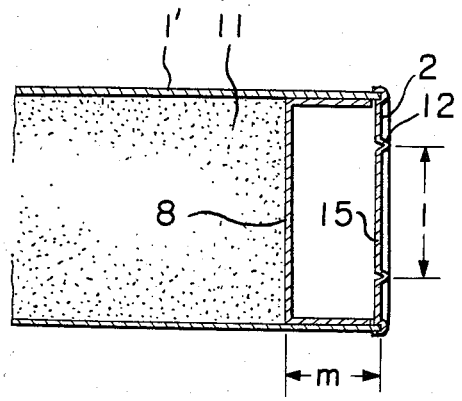
FIG. 3 is a partial cross sectional view of a cartridge can illustrating the relationship between the diameter of the punchable portion and the distance between the lid and the bottom of the receptacle.
Figure 4:
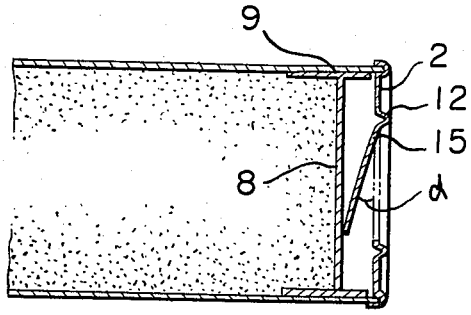
FIG. 4 is a partial cross sectional view of a cartridge can as a further embodiment of the present invention.

In a preferred embodiment shown in FIG. 3, the punching line 12 defines a circular punchable portion 15 and the diameter l of the circular punchable portion 15 is at least 1.8 times the distance m between the lid 7 and the bottom wall of the inner receptacle 8. When pushed by a plunger of a dispenser gun, the punchable portion will be punched out along the circular punching line 12. However, the rupture along the circular punching line does not take place simultaneously, but starts from a point where a stress is concentrated or from the weakest point on the punching line 12, and progressively advances along the punching line. Accordingly, it sometimes happens that the punched out piece becomes twisted around the plunger or is crushed between the wall of the receptacle and the plunger, whereby a proper dispensing operation or a proper withdrawal operation of the plunger after the dispensing operation is hindered. It has now been found that such undesirable twisting of the punched out piece can be avoided if the diameter l of the circular punchable portion 15 is set to be at least 1.8 times the distance m between the lid 2 and the bottom wall of the inner receptacle 8. Referring to FIG. 4, the inclination angle $\alpha$ of the partly punched portion 15 relates to the interrelation between the diameter l and the distance m, and the greater the angle $\alpha$ is, the greater the possibility of the undesirable twisting becomes. Conversely, the smaller the angle $\alpha$, the smaller the possibility of the twisting becomes. As a result of repeated experiments, it has been found that when an aluminum plate having a thickness of 0.5 mm is used as the lid as is commonly employed, it is possible to avoid the undesirable twisting of the punched out piece if the ratio of l/m is always at least 1.8.

FIG. 4 illustrates an embodiment in which the inner receptacle is made shallower than the preceeding embodiment by providing the bottom wall 8 at an intermediate position of the sliding contact portion 9, to set the ratio of l/m greater than 1.8 and thereby to ensure the avoidance of the twisting or crushing of the punched out piece. The upper limit of l/m is not critical, but it is usually 15.

In the conventional cartridge wherein a solid moisture absorber is placed in the inner receptacle 8, it frequently occurs that a solidified reaction product of the stored material 11 deposits on the sliding contact portion 9, whereby the inner receptacle is prevented from a proper sliding movement. According to the present invention wherein a low molecular weight chemical reagent such as an isocyanate, a silane, an alkyl titanate, a mixture thereof is placed in the receptacle 8, a small amount of a non-viscous substance will be deposited along the mouth portion of the container, and there is no possibility that the sliding movement of the inner receptacle is thereby hindered.

The material or composition to be stored in the drum or the cartridge of the present invention, may be any moisture absorptive material or moisture curable composition. However, the container of the present invention is particularly useful for the storage or dispensing of a moisture curable polyurethane, silicone or modified silicone composition. If these compositions are stored in the above-mentioned container without using the chemical reagent of the present invention, they are likely to absorb moisture from the air coming in through the sealing portion of the container and form a viscous substance at the mouth of the container, whereby the opening of the lid or the discharge of the stored material will be extremely difficult.

The reactive compound of the present invention is liquid or highly volatile at room temperature and capable of reacting with moisture to form a low viscosity substance which seals the sealing portion of the container, whereby the inflow of moist air from outside is effectively prevented. The reactive compound preferably has a molecular weight of from 100 to 1,000 and a vapor pressure of at least 0.01 mmHg.

The present invention will now be described with reference to Examples. However, it should be understood that the present invention is by no means restricted by these specific Examples.

EXAMPLE 1

In this Example, a one component silicone sealant (Cemedine S-512®) was filled in a cartridge having a capacity of 333 ml, and stored at 50° C. under a relative humidity of 95% for 30 days. Thereafter, the cartridge was cooled to 20° C., and the stored material was discharged by pushing the inner receptacle with the plunger, and the pushing force (kg) of the plunger was measured.

The test was conducted with respect to (1) a case where no agent was placed in the inner receptacle having a capacity of 45 ml (as control), (2) a case where a solid moisture absorber such as silica gel, zeolite or quick lime was placed in the inner receptacle (as Comparative Examples), and (3) a case where a silane chemical reagent was placed in the inner receptacle. The pushing speed of the plunger was 100 mm/min. The results thereby obtained are shown in Table 1.

TABLE 1

| Moistureproof agent placed in the inner receptacle | | | Pushing force of the plunger (kg) | Solidification at the plunger (thickness: mm) |
|---|---|---|---|---|
| Kind | Name | Amount (g) | | |
| Control | None | 0 | 50–80 | 5–10 |
| Solid moisture absorbers | Silica gel | 1 | 40–60 | 5–8 |
| | Zeolite (Molecular Sieves 3A ®) | 1 | 50–70 | 5–8 |
| | Quick lime | 1 | 50–70 | 5–8 |
| | Methyltrimethoxy silane | 0.1 | 25 | None |
| | | 0.2 | 14 | " |
| | | 0.4 | 15 | " |
| | | 0.8 | 18 | " |
| Silane compounds | Tetramethoxy silane | 0.2 | 14 | " |
| | | 0.8 | 14 | " |
| | Phenylmethoxy silane | 0.3 | 15 | " |
| | | 0.6 | 15 | " |
| | γ-Methacryloxy propyltrimethoxy silane | 0.5 | 14 | " |
| | γ-Glycidoxypropyl trimethoxysilane | 0.5 | 13 | " |
| | γ-Aminopropyltri-ethoxysilane | 0.5 | 14 | " |
| | N—β(aminoethyl)-γ-aminopropyltri-methoxysilane | 0.5 | 14 | " |
| | γ-Mercaptopropyl trimethoxysilane | 0.5 | 15 | " |
| | γ-Chloropropyl-methyldimethoxy silane | 0.5 | 13 | " |
| | γ-Glycidoxypropyl methyldiisopropen-oxysilane | 0.5 | 18 | " |
| | Methyltriacetoxime silane | 0.5 | 17 | " |
| | Vinyltriacetoxime silane | 0.5 | 19 | " |

Note:
When a commercially available cartridge gun is employed, the dispensing operation can readily be conducted if the pushing force of the plunger is not greater than 30 kg, whereas if the pushing force is greater than 70 kg, the dispensing operation becomes difficult for an ordinary person.

EXAMPLE 2

The test was conducted in the same manner under the same conditions as in Example 1 except that the chemical reagent placed in the inner receptacle having a capacity of 45 ml was changed to an alkyl titanate compound. The test results are shown in Table 2.

TABLE 2

| Moistureproof agent placed in the inner receptacle | | | Pushing force of the plunger (kg) | Solidification at the plunger (thickness: mm) |
|---|---|---|---|---|
| Kind | Name | Amount (g) | | |
| Alkyl titanate compounds | Tetraisopropyl titanate | 0.2 | 20 | None |
| | Tetra-n-butyl titanate | 0.5 | 20 | " |
| | Tetra(2-ethyl-hexyl)titanate | 0.5 | 18 | " |

EXAMPLE 3

The test was conducted in the same manner under the same conditions as in Example 1 except that the chemical reagent placed in the inner receptacle having a capacity of 45 ml was changed to an isocyanate compound. The test results are shown in Table 3.

TABLE 3

| Moistureproof agent placed in the inner receptacle | | | Pushing force of the plunger (kg) | Solidification at the plunger (thickness: mm) |
|---|---|---|---|---|
| Kind | Name | Amount (g) | | |
| Isocyanate compounds | Sumidure 44V-20 ® | 0.5 | 20 | None |
| | | 0.1 | 17 | " |
| | Colonate L ® | 1 | 17 | " |
| | Sumidure N ® | 1 | 15 | " |
| | Takenate D110N ® | 1 | 14 | " |

EXAMPLE 4

The test was conducted in the same manner under the same conditions as in Example 1 except that the chemical reagent placed in the inner receptacle having a capacity of 45 ml was changed to the various combinations of silane compounds, isocyanate compounds and alkyl titanate compounds, as identified in Table 4. The test results are shown in Table 4.

TABLE 4

| Moistureproof agent placed in the inner receptacle | | | Pushing force of the plunger (kg) | Solidification at the plunger (thicknesss mm) |
|---|---|---|---|---|
| Kind | Name | Amount (g) | | |
| Mixture of silane compounds | Methylmethoxysilane and tetramethoxy silane (1:1 by weight) | 0.6 | 15 | None |
| | γ-Aminopropyltriethoxy silane, and N—β(amino-ethyl)γ-aminopropyl trimethoxysilane (1:1 by weight) | 0.5 | 14 | " |
| | γ-Glycidoxypropyl methyl diisopropenoxysilane and Methyltriacetoxysilane (1:1 by weight) | 0.5 | 17 | " |
| | Methyldimethoxysilane tetramethoxysilane and phenylmethoxysilane (1:1 by weight) | 0.3 | 18 | " |
| Mixtures of | Tetraisopropyl titanate | 0.2 | 20 | " |

TABLE 4-continued

| Moistureproof agent placed in the inner receptacle | | | Pushing force of the | Solidification at the plunger |
|---|---|---|---|---|
| Kind | Name | Amount (g) | plunger (kg) | (thicknesss mm) |
| alkyl titanate compounds | and tetranormalbutyl titanate (1:1 by weight) | | | |
| | Tetranormalbutyl titanate, tetra(2-ethylhexyl) titanate (1:1 by weight) | 0.4 | 15 | " |
| | Tetraisopropyl titanate, tetranormalbutyl titanate and tetra(2-ethylhexyl) titanate (1:1:1 by weight) | 0.6 | 15 | " |
| Mixtures of isocyanate compounds | Colonate L ® and Sumidure N ® (1:1 by weight) | 0.6 | 18 | " |
| | Colonate L ® and Takenate D110N ® (1:1 by weight) | 1 | 16 | " |
| | Colonate L ®, Sumidure N ® and Takenate D110N ® (1:1:1 by weight) | 0.9 | 15 | " |
| Mixtures of silane compounds and isocyanate compounds | Colonate L ® and methyltrimethoxysilane (1:1 by weight) | 0.6 | 16 | None |
| | Takenate D110N ® and tetramethoxysilane | 0.4 | 17 | " |
| | γ-Aminopropyltriethoxysilane and Colonate L ® | 0.4 | 15 | " |
| | Methyltrimethoxysilane, tetramethoxysilane, phenylmethoxysilane and Colonate L ® (1:1:1:1 by weight) | 0.8 | 14 | " |
| | Colonate L ®, Takenate D110 ®, methyltrimethoxysilane and tetramethoxysilane (1:1:1:1 by weight) | 0.8 | 15 | " |
| Mixtures of alkyl titanate compounds and isocyanate compounds | Tetraisopropyl titanate and Colonate L ® (1:1 by weight) | 0.4 | 17 | " |
| | Tetraisopropyl titanate tetra(2-ethylhexyl) titanate and Colonate L ® (1:1:1 by weight) | 0.6 | 14 | " |
| Mixtures of silane compounds, isocyanate compounds and alkyl titanate compounds | Methyltrimethoxysilane, Colonate L ® and tetraisopropyl titanate (1:1:1 by weight) | 0.6 | 15 | " |

EXAMPLE 5

The test was conducted in the same manner under the same conditions as in Example 1 except that the stored material was changed to a one component urethane sealant (Cemedine CS-1450 ®). The test results are shown in Table 5.

TABLE 5

| Moistureproof agent placed in the inner receptacle | | | Pushing force of the | Solidification at the plunger |
|---|---|---|---|---|
| Kind | Name | Amount (g) | plunger (kg) | (thickness: mm) |
| Silane compounds | Methyltrimethoxy silane | 0.5 | 30 | None |
| | Phenyltrimethoxy silane | 0.5 | 31 | " |
| Isocyanate compound | Sumidure N ® | 1 | 30 | " |

TABLE 5-continued

| Moistureproof agent placed in the inner receptacle | | | Pushing force of the | Solidification at the plunger |
|---|---|---|---|---|
| Kind | Name | Amount (g) | plunger (kg) | (thickness: mm) |
| Alkyl titanate compound | Tetraisobutyl titanate | 0.5 | 29 | " |
| Solid moisture absorber | None | — | 60–100 | 5–10 |
| | Silica gel | 1 | 60–100 | 5–10 |

EXAMPLE 6

In this Example, a one component modified silicone sealant (Cemedine S510B ®) was filled in a drum having a capacity of 20 liters, and an inner receptacle having a capacity of 4000 ml was formed by a vinyl sheet having a thickness of 100 μm and fitted in the mouth of the drum. The moistureproof agent shown in Table 6 was placed in the inner receptacle and a lid was caulked on the mouth of the drum. The sealed drum was stored at 50° C. under relative humidity of 95% for 14 days. Then, the drum was cooled to 20° C., and the solidification was examined and the thickness of the formed film was measured. The results are shown in Table 6.

TABLE 6

| Moistureproof agent placed in the inner receptacle | | | Solidification at the plunger |
|---|---|---|---|
| Kind | Name | Amount (g) | (thickness: mm) |
| Control | None | 0 | at least 20 |
| Solid moisture absorbers | Silica gel | 10 | at least 20 |
| | | 20 | at least 20 |
| | Molecular Sieves 3A | 10 | at least 20 |
| | | 20 | at least 20 |
| Silane compound | Methyltrimethoxysilane | 5 | 2-3 |
| | | 10 | None |
| | | 20 | None |

EXAMPLE 7

The test was conducted in the same manner under the same conditions as in Example 1 except that a one component silicone sealant (Cemedine No. 8060 ®) was used.

The test results are shown in Table 7.

TABLE 7

| Moistureproof agent placed in the inner receptacle | | | Pushing force of the | Solidification at the plunger |
|---|---|---|---|---|
| Kind | Name | Amount (g) | plunger (kg) | (thickness: mm) |
| Control | None | 0 | 25-30 | 5-10 |
| Solid moisture absorber | Silica gel | 1 | 25-30 | 5-10 |
| Silane compounds | Methyltrimethoxy silane | 0.2 | 18 | None |
| | Tetramethoxy silane | 0.2 | 17 | " |
| | Methyltriacetoxy silane | 0.2 | 17 | " |
| Alkyl titanate compound | Tetraisobutyl silane | 0.5 | 18 | " |

It is evident from the results of the foregoing Examples that when a chemical reagent according to the present invention, such as a silane, an isocyanate, an alkyl titanate or a mixture thereof, is placed in the inner receptacle in an amount of from 0.01 to 5 g per 100 ml of the capacity of the inner receptacle, it is possible to obtain a distinctly superior moistureproofing effect to that obtainable by placing the same amount of the conventional solid moisture absorbers, as evidenced by the pushing force of the plunger, the solidification of the stored material and the thickness of the formed film. Such a superior moistureproof effect is obtained irrespective of the type of the container i.e. whether the container is a storage can such as a drum, or a cartridge.

If the amount of the chemical reagent in the inner receptacle is less than 0.01 g per 100 ml of the capacity of the inner receptacle, no adequate moistureproof effect is obtainable. On the other hand, if the amount exceeds 5 g per 100 ml of the inner receptacle, no further improvement of the moistureproofing effect was observed.

What is claimed is:

1. In a container for storing a moisture-sensitive material, which comprises:

a cylindrical member for holding said material, having a first closed end and a second closed end;

a sliding member situated in said cylinder in proximity to the first closed end;

a fillable space between said first closed end and said sliding member, said sliding member having substantially the same diameter as said cylinder and being slidable along the sides of the cylinder so as to prevent moisture-sensitive materials within said cylinder from entering the fillable space;

the improvement which comprises filling said fillable space with a volatile moisture reactive agent selected from the group consisting of an isocyanate, a silane, an alkyl titanate and mixtures thereof, wherein said moisture reactive agent is capable of reacting with any moisture which penetrates into said fillable space, from outside the container, form a reaction product which forms a moisture-proof film along said sliding member, capable of preventing further penetration of moisture into said cylinder.

2. The container of claim 1, which further comprises:

a spout located in said second closed end through which said moisture-sensitive material can be dispensed, with said sliding member being placed in said container such that when external pressure is applied to said sliding member, the volume in said container contracts, thereby forcing said moisture-sensitive material through said spout.

3. The container of claim 2, wherein said first closed end is closed by a lid, said lid having located therein a punchable portion defined by punching lines.

4. The container of claim 1, wherein said moisture-reactive agent is a silane selected from the group consisting of methyltrimethoxy silane, tetramethoxy silane, phenylmethoxy silane, γ-methacryloxypropyltrimethoxy silane, γ-glycidoxypropyltrimethoxy silane, γ-aminopropyltriethoxy silane, N-β(aminoethyl)-γ-aminopropyltrimethoxy silane, γ-mercaptopropyl trimethoxy silane, γ-chloropropylmethyldimethoxy silane, γ-glycidoxypropyl methyldiisopropenoxy silane, methyltriacetoxime silane, and vinyltriacetoxime silane.

5. The container of claim 1, wherein said moisture-reactive agent is an alkyl titanate selected from the group consisting of tetraisopropyl titanate, tetra-n-butyl titanate, and tetra(2-ethylhexyl)titanate.

6. The container of claim 1, wherein said moisture-reactive agent contains methylmethoxy silane, tetramethoxy silane, γ-aminopropyltriethoxy silane, N-β(aminoethyl-γ-aminopropyltrimethoxy silane, γ-glycidoxypropylmethyldiisopropenoxy silane, methyltriacetoxy silane, methyldimethoxy silane, tetramethoxy silane, phenylmethoxy silane, tetraisopropyl titanate, tetra-n-butyl titanate, tetra-n-butyl titanate, tetra(2-ethyl-hexyl)titanate, tetraisopropyl titanate, tetra-n-butyl titanate, tetra(2-ethyl-hexyl)titanate, methyltrimethoxy silane, and mixtures thereof.

7. The container according to claim 1, wherein the isocyanate is a compound having a terminal —NCO group and being capable of reacting with water to produce $CO_2$ and to form a di-substituted urea derivative having a group represented by the formula —NH-CONH—, the silane is a compound having a hydrolyzable group represented by the formula:

$$X_{4-a}-\overset{\overset{R_a^1}{|}}{Si}-$$

where $R^1$ is a monovalent hydrocarbon group having from 1 to 12 carbon atoms selected from an alkyl group and an aryl group, or an alkylsilyloxy group, X is an alkoxy group, an amido group, an acid amido group, an aminooxy group, an amino group, a mercapto group or a silyloxy group having a hydrolyzable functional group, and a is an integer of 0, 1 or 2; and the alkyl titanate is a compound represented by the formula:

$$Ti(OR^2)_4$$

where $R^2$ is a monovalent hydrocarbon group having from 1 to 6 carbon atoms.

8. The container according to claim 1, wherein the moisture-sensitive material stored within the container is a moisture curable polyurethane, silicone or modified silicone composition.

9. The container according to claim 3, wherein the punching line is engraved to a depth corresponding to about a half of the wall thickness of the lid.

10. The container according to claim 3, wherein the punching line defines a circular punchable portion and the diameter of the circlar punchable portion is at least 1.8 times the distance between the lid and the sliding member.

11. The container according to claim 3, wherein the punchable portion has a projection adjacent to the punching line.

12. The container according to claim 1, wherein the moisture reactive agent is liquid or highly volatile at room temperature and capable of reacting with moisture to form a low viscosity substance and which has a molecular weight of from 100 to 1,000 and a vapour pressure of at least 0.01 mmHg.

13. The container according to claim 12, wherein the moisture reactive agent is placed in the inner receptacle in an amount of from about 0.01 to about 5 g per 100 $cm^3$ of the capacity of the inner receptacle.

* * * * *